US009785068B2

(12) United States Patent
Umeda et al.

(10) Patent No.: US 9,785,068 B2
(45) Date of Patent: Oct. 10, 2017

(54) TONER

(71) Applicant: CANON KABUSHIKI KAISHA, Tokyo (JP)

(72) Inventors: Noriyoshi Umeda, Suntou-gun (JP); Takeshi Kaburagi, Suntou-gun (JP); Naotaka Ikeda, Suntou-gun (JP); Hirofumi Kyuushima, Mishima (JP); Shohei Shibahara, Suntou-gun (JP); Yoshiaki Wada, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/245,360

(22) Filed: Aug. 24, 2016

(65) Prior Publication Data

US 2017/0075243 A1 Mar. 16, 2017

(30) Foreign Application Priority Data

Aug. 28, 2015 (JP) ..... 2015-169026

(51) Int. Cl.
*G03G 9/097* (2006.01)
*G03G 9/08* (2006.01)
*G03G 9/087* (2006.01)

(52) U.S. Cl.
CPC ..... *G03G 9/0825* (2013.01); *G03G 9/0806* (2013.01); *G03G 9/0819* (2013.01); *G03G 9/08711* (2013.01); *G03G 9/08782* (2013.01)

(58) Field of Classification Search
CPC ..... G03G 9/0825; G03G 9/08782; G03G 9/08711; G03G 9/08755; G03G 9/09733
USPC ..... 430/109.4, 109.3
See application file for complete search history.

(56) References Cited

U.S. PATENT DOCUMENTS

| | | | |
|---|---|---|---|
| 6,638,674 | B2 | 10/2003 | Komoto et al. |
| 6,653,035 | B2 | 11/2003 | Komoto et al. |
| 6,936,394 | B2 | 8/2005 | Okado et al. |
| 7,029,813 | B2 | 4/2006 | Mikuriya et al. |
| 7,043,175 | B2 | 5/2006 | Komoto et al. |
| 7,112,393 | B2 | 9/2006 | Komoto et al. |
| 7,135,263 | B2 | 11/2006 | Kawakami et al. |
| 7,153,625 | B2 | 12/2006 | Kaburagi et al. |
| 7,160,663 | B2 | 1/2007 | Komoto et al. |
| 7,387,860 | B2 | 6/2008 | Moriki et al. |
| 7,560,212 | B2 | 7/2009 | Chiba et al. |
| 7,611,813 | B2 | 11/2009 | Ida et al. |
| 7,704,661 | B2 | 4/2010 | Ikeda et al. |
| 7,785,760 | B2 * | 8/2010 | Yamamoto ..... G03G 9/0819 430/108.8 |
| 7,906,262 | B2 | 3/2011 | Ishigami et al. |
| 8,652,725 | B2 | 2/2014 | Watanabe et al. |
| 8,841,056 | B2 | 9/2014 | Yoshizaki et al. |
| 8,916,319 | B2 | 12/2014 | Ikeda et al. |
| 8,940,467 | B2 | 1/2015 | Hashimoto et al. |
| 9,229,345 | B2 | 1/2016 | Ikeda et al. |
| 9,261,806 | B2 | 2/2016 | Moribe et al. |
| 9,285,697 | B2 | 3/2016 | Fukudome et al. |
| 9,423,714 | B2 | 8/2016 | Kenmoku et al. |
| 2006/0166120 | A1 | 7/2006 | Moriki et al. |
| 2010/0104965 | A1 | 4/2010 | Inoue et al. |
| 2015/0248071 | A1 | 9/2015 | Katsura et al. |
| 2015/0370189 | A1 | 12/2015 | Tanaka et al. |

FOREIGN PATENT DOCUMENTS

| | | |
|---|---|---|
| JP | 2007-171272 | 7/2007 |
| JP | 2010-122667 | 6/2010 |

OTHER PUBLICATIONS

Fedors, "A Method for Estimating Both the Solubility Parameters and Molar Volumes of Liquids", Polymer Engineering and Science, vol. 14, No. 2 (1974) 147-54.

* cited by examiner

*Primary Examiner* — Janis L Dote
(74) *Attorney, Agent, or Firm* — Fitzpatrick, Cella, Harper & Scinto

(57) ABSTRACT

The toner has a toner particle that contains a binder resin and a wax, wherein the wax is present in domain form in the interior of the toner particle; the proportion of toner particles for which the position of the wax domains are controlled, is in a prescribed range; using d for a major axis length of the domain having the largest major axis length and using D for a number-average particle diameter of the toner, the d and D satisfy a prescribed relationship; and the ratio between the major axis length and the minor axis length of the domain having the largest major axis length is in a prescribed range.

6 Claims, No Drawings

TONER

BACKGROUND OF THE INVENTION

Field of the Invention

The present invention relates to a toner that is used to form a toner image through the development of an electrostatic latent image formed by a method such as electrophotography, electrostatic recording, and toner jet system recording methods.

Description of the Related Art

Higher productivities and the ability to output high-definition full-color images have been required of copiers and printers in a broad field from the office to the home in recent years. Within this context, users are making a wide range of demands, i.e., increasing copying machine and printer speed is important and at the same time there is demand for the image quality required to print photographs and for the ability to print images that have small edge margins.

Increasing the speed of a copying machine or printer first of all means increasing the speed of the developing system. The developing system is an image-forming process that uses toner to bring about a visualization of the electrostatic latent image. Its operation is accompanied by both toner-to-toner contact and toner-to-component member contact, and the toner is repetitively subjected to loading each time this contact occurs. The toner ends up being degraded by this loading and the flowability and tribochargeability required for performance as a developer then undergo a gradual decline. In addition, it has been found that toner in this condition presents a reduced amount of charge and a non-uniform charge distribution, resulting in the occurrence of image defects.

To respond to these problems, for example, Japanese Patent Application Laid-open No. 2007-171272 proposes a toner having a core-shell structure in which a shell layer coats a core particle that contains a binder resin, colorant, and release agent, and having a certain prescribed range specified for its average fracture strength. With this method, an art is disclosed that brings about an improvement in the ability of the toner to resist the degradation due to the loading that the toner receives. In the case of core-shell structures, there is a clear strengthening with respect to the loading to which the toner is repetitively subjected. However, with methods in which the toner particle is produced in an aqueous medium, such as the suspension polymerization method used in Japanese Patent Application Laid-open No. 2007-171272, the wax tends to segregate to the neighborhood of the center of the toner. As a consequence, outmigration of the wax from the toner during fixing is impeded and wraparound on the fixing member tends to occur easily in the case of an image having small edge margins.

Japanese Patent Application Laid-open No. 2010-122667 therefore proposes, for solution suspension methods where toner production is carried out using an aqueous medium, a method of dispersing the wax in the toner using a wax dispersing agent. The wax is definitely dispersed in the toner particle and wax is also present in the neighborhood of the toner surface. Compatibility between the binder resin and wax during fixing is facilitated as a result, and due to this an effect on the low-temperature fixability appears. However, when the binder resin and wax are compatible, this is not effective with regard to the separation behavior of the paper due to a loss of the functional effect as a wax.

SUMMARY OF THE INVENTION

Thus, as indicated above, a toner has yet to be introduced in which a robustness to loading capable of responding to increases in developing system speed can coexist with an efficient outmigration of the wax during fixing. The present invention provides a toner that solves these existing problems. That is, an object of the present invention is to provide a toner that exhibits a stable developing performance throughout the service life in a high-speed developing system and that, even during the formation of an image with small edge margins, is capable of providing separation without paper wraparound on the fixing roller.

In order to achieve this object, the invention according to the present application is a toner that has a toner particle that contains a binder resin and a wax, wherein, in a three-dimensional analysis of the internal structure of the toner particle, (i) the wax is present in domain form in the interior of the toner particle;

(ii) the proportion of toner particles for which a shortest distance between a surface of the toner particle and a domain having a largest major axis length among the domains of the wax is less than 50 nm, is equal to or less than 10.0 number %;

(iii) the proportion of toner particles for which the shortest distance between the surface of the toner particle and the domain having the largest major axis length is at least 50 nm and not more than 500 nm, is equal to or greater than 60.0 number %;

(iv) using d for a major axis length of the domain having the largest major axis length and using D for a number-average particle diameter (D1) of the toner, the d and D satisfy the relationship with the following formula (1)

$$0.25D<d<0.50D \quad (1); \text{ and}$$

(v) the ratio between the major axis length and a minor axis length (major axis length/minor axis length) of the domain having the largest major axis length is at least 1.0 and not more than 2.5.

The present invention can provide a toner that exhibits a stable developing performance throughout the service life in a high-speed developing system and that, even during the formation of an image with small edge margins, is capable of providing separation without paper wraparound on the fixing roller.

Further features of the present invention will become apparent from the following description of exemplary embodiments.

DESCRIPTION OF THE EMBODIMENTS

The present invention is described in the following.

By having the toner in the present invention satisfy the conditions indicated above, a toner can be obtained that exhibits a stable developing performance throughout the service life in a high-speed developing system and that, even during the formation of an image with small edge margins, is capable of providing separation without paper wraparound on the fixing roller.

The detailed reasons as to why the present invention is obtained by the method of satisfying the conditions indicated above are unclear, but the present inventors hypothesize as follows.

Thus, in order to respond to high-speed developing systems, preferably there is the least possible exposure of the wax at the toner surface. However, when the paper separation behavior during fixing is considered, a large amount of wax in the neighborhood of the toner surface then becomes necessary. In addition, when the wax is finely dispersed in the toner, the effect as a wax then ends up being reduced due to compatibility with the binder resin upon the heating during fixing. As a consequence, preferably wax domains brought to a certain size are present in the neighborhood of the toner surface in a state in which there is the least possible exposure of the wax at the toner surface.

On the other hand, depending on the size and shape of the wax domains in the toner, cracking and chipping of the toner may be readily produced by the repetitive loading received during extended development. The flowability and tribochargeability required for performance as a developer gradually decline as a result and image defects are then produced. It is thought that, as a consequence, control of the size and shape of the wax domains is crucial.

Thus, in order to respond to high-speed developing systems and bring about separation of the paper without wraparound on the fixing roller even with images that have small edge margins, the conclusion can be drawn that the effects of the wax can be fully utilized by controlling the size, shape, and position of the wax in the toner.

The present inventors discovered that a toner that solves the problems described in the preceding is obtained by having the construction and properties described in detail herebelow.

The present invention is a toner having a toner particle that contains a binder resin and a wax. When three-dimensional analysis is carried out on the internal structure of this toner particle, wax is present in domain form in the interior of the toner particle. While the details of the three-dimensional analysis are described below, the fact that wax domains can be observed shows that the wax is present in a crystalline state. It thus means that a releasing effect can be exhibited.

Given this perspective, it is then essential for the toner of the present invention that (i) wax is present in domain form in the interior of the toner particle and (ii) the proportion of toner particles for which the shortest distance between the surface of the toner particle and the domain having the largest major axis length among these wax domains is less than 50 nm, is equal to or less than 10.0 number %. This indicates that there is very little exposure of the wax at the toner surface.

A suppression of component member contamination by the wax is made possible even in high-speed developing systems and a stable developing performance throughout the service life is then obtained. However, when the proportion of toner particles for which the shortest distance between the surface of the toner particle and the domain having the largest major axis length among the wax domains is less than 50 nm, is greater than 10.0 number %, image defects—e.g., development stripes and so forth—end up being produced due to contamination of component members by the wax when the toner is subjected to loading in a high-speed development system. The proportion of toner particles in which the shortest distance to the toner particle surface is less than 50 nm is preferably at least 0.0 number % and not more than 7.0 number % and is more preferably at least 0.0 number % and not more than 4.0 number %. The proportion of toner particles in which the shortest distance to the toner particle surface is less than 50 nm can be controlled through the composition and content of the wax and, when two species of wax are used, through the ratio therebetween.

It has also been found that, when a design is used in which the wax domains are segregated to the interior of the toner in order to suppress image defects such as development stripes, outmigration of the wax to the toner surface during fixing is then impeded and as a consequence the paper separation behavior is poor and wraparound by the paper at the fixing roller is produced.

It is then essential for the present invention that (iii) the proportion of toner particles for which the shortest distance between the surface of the toner particle and the domain having the largest major axis length is at least 50 nm and not more than 500 nm, is equal to or greater than 60.0 number % and (iv) using d for the major axis length of the domain having the largest major axis length and using D for the number-average particle diameter (D1) of the toner, the d and D satisfy the relationship with the following formula (1):

$$0.25D<d<0.50D \quad (1).$$

These indicate the optimal position and size of the wax domains for having the wax undergo an efficient outmigration during fixing. Thus, controlling into these ranges makes it possible for the wax to very efficiently transfer out to the toner surface when pressure and heat have been applied to the toner during fixing. Paper wraparound on the fixing roller can be suppressed as a result.

However, when the proportion of toner particles for which the shortest distance between the surface of the toner particle and the domain having the largest major axis length is at least 50 nm and not more than 500 nm, is less than 60.0 number %, outmigration of the wax to the toner surface during fixing is then impeded and as a consequence paper wraparound on the fixing roller tends to occur. In addition, when $0.25D \geq d$, the wax domains have a small size and as a consequence compatibilization with the binder resin ends up occurring during fixing prior to the wax transferring out to the toner surface and little releasing effect then appears. Thus, due to the low detachability by the paper, paper wraparound on the fixing roller tends to occur easily. When, on the other hand, $d \geq 0.50D$, the wax domains have a large size and as a consequence a trend occurs whereby the toner undergoes cracking and chipping when the toner is subjected to loading in a high-speed developing system.

The proportion of toner particles for which the shortest distance between the surface of the toner particle and the domain having the largest major axis length is at least 50 nm and not more than 500 nm, is preferably at least 70.0 number % and not more than 100.0 number % and more preferably at least 80.0 number % and not more than 100.0 number %. The proportion of toner particles for which the shortest distance is at least 50 nm and not more than 500 nm can be controlled through the composition and content of the wax and, when two species of wax are used, through the ratio therebetween.

The d in formula (1), which is the major axis length of the domain having the largest major axis length, is preferably at least 0.30D and not more than 0.45D and is more preferably at least 0.35D and not more than 0.40D. The major axis length d of the domain having the largest major axis length can be controlled through the composition and content of the wax and, when two species of wax are used, through the ratio therebetween.

It was also found that, when wax domains are present in toner particles, toner particle cracking and chipping, for which the wax domains are an interface, ends up occurring due to the repetitive loading received by the toner in a high-speed developing system. It is therefore essential that (v) the ratio between the major axis length and the minor axis length (major axis length/minor axis length) of the domain having the largest major axis length be at least 1.0 and not more than 2.5.

This is indicative of the shape of the wax domain. When the wax domain approaches a sphere, toner cracking and chipping are suppressed because the force due to repetitive loading of the toner is uniformly dispersed. However, when the ratio between the major axis length and the minor axis length (major axis length/minor axis length) of the domain having the largest major axis length is larger than 2.5, the force due to repetitive loading of the toner is concentrated due to the wax assuming an irregular shape, and as a consequence, toner particle cracking and chipping at the wax domain interface is likely to occur.

In addition, the ratio between the major axis length and the minor axis length (major axis length/minor axis length) of the domain having the largest major axis length is preferably at least 1.0 and not more than 2.0 and is more preferably at least 1.0 and not more than 1.5. The ratio between the major axis length and the minor axis length (major axis length/minor axis length) of the domain having the largest major axis length can be controlled through the composition and content of the wax and, when two species of wax are used, through the ratio therebetween.

Additional preferred embodiments of the invention are described below for the toner of the present invention. Preferably the wax contains two species, a wax A and a wax B, with the wax A being a hydrocarbon wax and the wax B being an ester wax. More preferably, the wax B is an ester of a hexahydric alcohol and an aliphatic acid or is an ester of a hexabasic carboxylic acid and an aliphatic alcohol. It is even more preferably the ester of a hexahydric alcohol and an aliphatic monocarboxylic acid or the ester of a hexabasic carboxylic acid and an aliphatic monoalcohol. It is thought that the releasing effect of the wax and the position of the wax domains can be controlled through the presence of two species of wax having different compositions.

The releasability is strengthened when wax A, i.e., a hydrocarbon wax, is incorporated. In addition, when wax B, i.e., an ester wax, is incorporated, all or part forms a eutectic with wax A. In particular, in an aqueous medium, due to the influence of the highly polar wax B, the domains of the eutectic wax tend to be present in the vicinity of the toner surface.

Moreover, when the wax B is an ester of a hexahydric alcohol and an aliphatic acid or an ester of a hexabasic carboxylic acid and an aliphatic alcohol, the molecular chain is then strongly branched and due to this a trend occurs whereby the wax domain becomes spherical through the formation of a eutectic between all or part and the wax A. This yields additional improvements in the resistance to cracking and resistance to chipping exhibited by the toner. Among the hexahydric alcohol/aliphatic acid esters and hexabasic carboxylic acid/aliphatic alcohol esters, esters of dipentaerythritol and an aliphatic monocarboxylic acid exhibit the best effects in the present invention.

The toner of the present invention may also contain a resin A. This resin A preferably contains a polymer that has the salicylic acid-structured segment given by formula (2) below in a terminal position in a side chain. (Each $R^1$ independently represents an alkyl group having at least 1 and not more than 18 carbons or an alkoxyl group having at least 1 and not more than 18 carbons. n represents an integer that is at least 0 and not more than 3, and * is a bonding segment in the polymer.)

[C1]

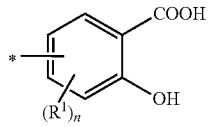

(2)

In a preferred case wherein the toner contains the wax B ester wax, the polymer having a segment given by formula (2), and a binder resin that contains the benzene ring and ester bond, first of all the carboxyl group and/or hydroxyl group in the structure of the polymer having the salicylic acid-structured segment given by formula (2) in the terminal position in the side chain coordinates with the carboxyl group in the wax B ester wax. When this state is assumed, the polymer having the segment with formula (2) in the terminal position in the side chain attracts the ester wax.

In particular, in an aqueous medium, the polymer having the segment with formula (2) in the terminal position in the side chain is, due to its high polarity, preferentially present at the toner surface. There is then a strong tendency for the wax domains containing the ester wax coordinated to this polymer to be present in the neighborhood of the toner surface. By controlling the position of the wax domains to the vicinity of the toner surface as a result, it is thought that outmigration of the wax to the toner surface during fixing is facilitated and paper wraparound on the fixing roller can thereby be suppressed.

In addition, the toner particle is preferably a toner particle that is produced via a step of granulation in an aqueous medium. The reason for this is that the exposure of the wax domains at the toner surface can be suppressed by having a step of granulation in an aqueous medium.

Moreover, the toner particle contained in the toner of the present invention is preferably a toner particle obtained by forming, in an aqueous medium, a particle of a polymerizable monomer composition containing a polymerizable monomer, wax, and as necessary additives such as the resin A, colorant, and so forth, and polymerizing the polymerizable monomer present in the particle of the polymerizable monomer composition.

The following formula (3) is more preferably satisfied where SPa is the SP value of the wax A and SPb is the SP value of the wax B.

$$SPb-SPa>0.3 \quad (3)$$

When this formula (3) is satisfied, an even better control of the position of the wax domains to the neighborhood of the toner surface is made possible. In particular, when the toner is produced in an aqueous medium, it is thought that, through the influence of the wax B with its higher SP value, domains of the wax A/wax B eutectic can be caused to be present in the vicinity of the toner surface.

SPb−SPa is preferably at least 0.5. While there are no particular limitations on the upper limit here, it is generally not more than 3.0 and preferably not more than 1.0. The SP value of the waxes can be controlled through the starting materials used.

The materials used in the toner of the present invention are described in the following.

(Binder Resin)

A resin containing the benzene ring and the ester bond is preferably used as the binder resin in the toner of the present invention. Resins containing the benzene ring and ester bond can be exemplified by styrene-acrylic resins, styrene-methacrylic resins, and polyester resins having as constituent components at least a bisphenol derivative as a diol component and isophthalic acid or terephthalic acid as a dicarboxylic acid component.

Among the preceding, the binder resin in the toner of the present invention is preferably a styrene-acrylic resin. The effects of the present invention are even more favorably expressed when the styrene monomer unit is contained at at least 60.0 mass % and not more than 100.0 mass % with reference to the total monomer unit in the styrene-acrylic resin. Here, "monomer unit" refers to the reacted state of the monomer substance in the polymer.

Known resins can be used when the binder resin is a styrene-acrylic resin. In addition, when the toner particle is obtained using a suspension polymerization method, the styrene-acrylic resin may be produced by copolymerizing the styrene and acrylate ester polymerizable monomers during the suspension polymerization reaction.

The polymerizable monomers that can be used can be specifically exemplified by the following: styrene; styrene derivatives such as α-methylstyrene, β-methylstyrene, o-methylstyrene, m-methylstyrene, p-methylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, and p-phenylstyrene; and acrylic polymerizable monomers such as methyl acrylate, ethyl acrylate, n-propyl acrylate, isopropyl acrylate, n-butyl acrylate, isobutyl acrylate, tert-butyl acrylate, n-amyl acrylate, n-hexyl acrylate, 2-ethylhexyl acrylate, n-octyl acrylate, n-nonyl acrylate, cyclohexyl acrylate, benzyl acrylate, dimethyl phosphate ethyl acrylate, diethyl phosphate ethyl acrylate, dibutyl phosphate ethyl acrylate, and 2-benzoyloxyethyl acrylate.

Various polymerization initiators, e.g., peroxide-type polymerization initiators, azo-type polymerization initiators, and so forth, can be used as the polymerization initiator usable in the production of this styrene-acrylic resin. The usable organic peroxide-type polymerization initiators can be exemplified by peroxyesters, peroxydicarbonates, dialkyl peroxides, peroxyketals, ketone peroxides, hydroperoxides, and diacyl peroxides.

The inorganic types can be exemplified by persulfate salts and hydrogen peroxide. Specific examples are peroxyesters such as t-butyl peroxyacetate, t-butyl peroxypivalate, t-butyl peroxyisobutyrate, t-hexyl peroxyacetate, t-hexyl peroxypivalate, t-hexyl peroxyisobutyrate, t-butylperoxy isopropyl monocarbonate, and t-butylperoxy 2-ethylhexyl monocarbonate; diacyl peroxides such as benzoyl peroxide; peroxydicarbonates such as diisopropyl peroxydicarbonate; peroxyketals such as 1,1-di-t-hexylperoxycyclohexane; dialkyl peroxides such as di-t-butyl peroxide; and also t-butylperoxy allyl monocarbonate.

The usable azo-type polymerization initiators can be exemplified by 2,2'-azobis(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, azobisisobutyronitrile, and dimethyl 2,2'-azobis(2-methylpropionate).

Two or more of these polymerization initiators can also be used at the same time as necessary. The amount of polymerization initiator used here is preferably at least 0.1 mass parts and not more than 20.0 mass parts per 100.0 mass parts of the polymerizable monomer.

The weight-average molecular weight (Mw) of the binder resin in the toner of the present invention is not an issue as long as the low-temperature fixability and storage stability are satisfied, and at least 4,000 and not more than 100,000 is preferred. The weight-average molecular weight can be controlled using known methods, e.g., through the amount of the initiator, the reaction temperature, the reaction solvent, and so forth.

(Resin A)

A polymer having the segment given by formula (2) below is preferably used as the resin A in the toner of the present invention.

[C2]

(2)

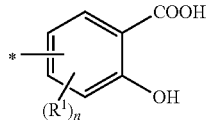

(Each $R^1$ independently represents an alkyl group having at least 1 and not more than 18 carbons or an alkoxyl group having at least 1 and not more than 18 carbons. The n represents an integer that is at least 0 and not more than 3, and * is a bonding segment in the polymer.)

The segment represented by formula (2) is more preferably a segment with the following formula (2-1).

[C3]

(2-1)

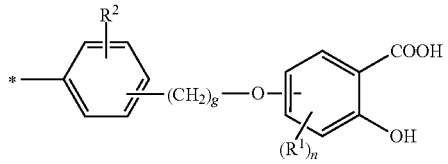

(In formula (2-1), each $R^1$ independently represents an alkyl group having at least 1 and not more than 18 carbons (preferably at least 1 and not more than 4 carbons) or an alkoxy group having at least 1 and not more than 18 carbons (preferably at least 1 and not more than 4 carbons). $R^2$ represents a hydrogen atom, a hydroxy group, an alkyl group having at least 1 and not more than 18 carbons (preferably at least 1 and not more than 4 carbons), or an alkoxy group having at least 1 and not more than 18 carbons (preferably at least 1 and not more than 4 carbons). The g represents an integer that is at least 1 and not more than 3; h represents an integer that is at least 0 and not more than 3; and * is a bonding segment in the polymer.)

Polymer containing the segment with formula (2) can be produced by known methods using a polymerizable monomer having formula (2). Salicylic acid-structured polymerizable monomers that can be used are specifically exemplified by the following: 3-vinylsalicylic acid, 4-vinylsalicylic acid, 5-vinylsalicylic acid, 6-vinylsalicylic acid, 3-vinyl-5-isopropylsalicylic acid, 3-vinyl-5-t-butylsalicylic acid, and 4-vinyl-6-t-butylsalicylic acid.

In addition, polymer containing the segment with formula (2-1) can be synthesized, for example, using as monomer a compound having a polymerizable functional group, e.g., the vinyl group, for the * in the structure given by formula (2-1). In such a case, the segment given by formula (2-1) is then given by the following formula (2-2).

[C4]

(2-2)

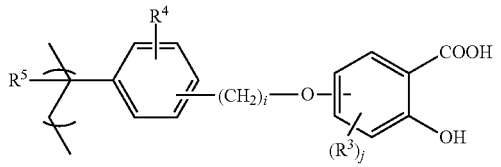

(In formula (2-2), each $R^3$ independently represents an alkyl group having at least 1 and not more than 18 carbons (preferably at least 1 and not more than 4 carbons) or an alkoxy group having at least 1 and not more than 18 carbons (preferably at least 1 and not more than 4 carbons). $R^4$ represents a hydrogen atom, a hydroxy group, an alkyl group having at least 1 and not more than 18 carbons (preferably at least 1 and not more than 4 carbons), or an alkoxy group having at least 1 and not more than 18 carbons (preferably at least 1 and not more than 4 carbons). $R^5$ represents a hydrogen atom or a methyl group; i represents an integer that is at least 1 and not more than 3; and j represents an integer that is at least 0 and not more than 3.)

The polymer containing the segment with formula (2) may be a homopolymer or may be a copolymer with another polymerizable monomer. The following are specific examples of polymerizable monomers that can be used for the copolymer: styrene; styrene derivatives such as α-methylstyrene, β-methylstyrene, o-methylstyrene, m-methylstyrene, p-methylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, and p-phenylstyrene; acrylic polymerizable monomers such as methyl acrylate, ethyl acrylate, n-propyl acrylate, isopropyl acrylate, n-butyl acrylate, isobutyl acrylate, tert-butyl acrylate, n-amyl acrylate, n-hexyl acrylate, 2-ethylhexyl acrylate, n-octyl acrylate, n-nonyl acrylate, cyclohexyl acrylate, benzyl acrylate, dimethyl phosphate ethyl acrylate, diethyl phosphate ethyl acrylate, dibutyl phosphate ethyl acrylate, and 2-benzoyloxyethyl acrylate; and methacrylic polymerizable monomers such as methyl methacrylate, ethyl methacrylate, n-propyl methacrylate, isopropyl methacrylate, n-butyl methacrylate, isobutyl methacrylate, tert-butyl methacrylate, n-amyl methacrylate, n-hexyl methacrylate, 2-ethylhexyl methacrylate, n-octyl methacrylate, n-nonyl methacrylate, diethyl phosphate ethyl methacrylate, and dibutyl phosphate ethyl methacrylate.

The same polymerization initiators as referenced above can be used as polymerization initiators usable in the production of the polymer containing a segment with formula (2).

The weight-average molecular weight (Mw) of the resin A in the toner of the present invention is not an issue as long as the low-temperature fixability and storage stability are satisfied, and at least 4,000 and not more than 100,000 is preferred. The weight-average molecular weight can be controlled using known methods, e.g., through the amount of the initiator, the reaction temperature, the reaction solvent, and so forth.

The weight-average molecular weight (Mw) of the polymer containing a segment with formula (2) in the toner of the present invention is not an issue as long as the low-temperature fixability and storage stability are satisfied, and at least 4,000 and not more than 100,000 is preferred. The weight-average molecular weight can be controlled using known methods, e.g., through the amount of the initiator, the reaction temperature, the reaction solvent, and so forth.

The effects of the present invention are even more favorably exhibited by the toner of the present invention at a content of the segment with formula (2) in the resin A of at least 0.1 μmol/g and not more than 100.0 μmol/g.

It is thought that, when the content of the segment with formula (2) that is contained by the toner is in the indicated range, the polymer having the segment with formula (2) in the toner then satisfactorily exhibits the function of a dispersing agent for the multifunctional ester wax in the toner and the effects of the present invention are even more favorably exhibited.

The content of the segment with formula (2) that is contained by the toner can be controlled by adjusting the amount of addition during toner production based on the content of the segment with formula (2) in the resin A. The content of the segment with formula (2) contained in the resin A can be quantitated based on measurement of the acid value of the resin, infra.

In addition, the content of the resin A in the toner is preferably at least 0.5 mass parts and not more than 10.0 mass parts per 100.0 mass parts of the binder resin.

(Colorant)

The toner of the present invention may also be used in the form of a magnetic toner, in which case a magnetic body as exemplified by the following is used: iron oxides such as magnetite, maghemite, and ferrite, and iron oxides that contain another metal oxide; metals such as Fe, Co, and Ni, as well as alloys of these metals with a metal such as Al, Co, Cu, Pb, Mg, Ni, Sn, Zn, Sb, Ca, Mn, Se, or Ti, and mixtures of the preceding; and iron(II,III) oxide ($Fe_3O_4$), ferric oxide ($\gamma$-$Fe_2O_3$), zinc iron oxide ($ZnFe_2O_4$), copper iron oxide ($CuFe_2O_4$), neodymium iron oxide ($NdFe_2O_3$), barium iron oxide ($BaFe_{12}O_{19}$), magnesium iron oxide ($MgFe_2O_4$), and manganese iron oxide ($MnFe_2O_4$). A single one of these magnetic materials may be used or a combination of two or more may be used. A finely divided powder of iron(II,III) oxide or γ-ferric oxide is a particularly favorable magnetic material.

These magnetic bodies preferably have an average particle diameter of at least 0.1 μm and not more than 2.0 μm and more preferably at least 0.1 μm and not more than 0.3 μm. The magnetic properties for the application of 795.8 kA/m (10 koersted) are as follows: a coercive force (Hc) of at least 1.6 kA/m and not more than 12 kA/m (at least 20 oersted and not more than 150 oersted), and a saturation magnetization (σs) of at least 5 $Am^2/kg$ and not more than 200 $Am^2/kg$ and preferably of at least 50 $Am^2/kg$ and not more than 100 $Am^2/kg$. The residual magnetization (σr) is preferably at least 2 $Am^2/kg$ and not more than 20 $Am^2/kg$.

Considered per 100.0 mass parts of the binder resin, the magnetic body is used preferably at at least 10.0 mass parts and not more than 200.0 mass parts and more preferably at at least 20.0 mass parts and not more than 150.0 mass parts.

On the other hand, a known colorant, e.g., the various heretofore known dyes and pigments, can be used as the colorant in the case of use as a nonmagnetic toner.

The black colorant may be a carbon black, aniline black, acetylene black, titanium black, or a black colorant provided by color mixing to yield black using the yellow/magenta/cyan colorants described in the following.

For pigment-based yellow colorants, compounds as typified by condensed azo compounds, isoindolinone compounds, anthraquinone compounds, azo-metal complexes, methine compounds, and allylamide compounds may be used. Specific examples are C. I. Pigment Yellow 3, 7, 10, 12, 13, 14, 15, 17, 23, 24, 60, 62, 74, 75, 83, 93, 94, 95, 99, 100, 101, 104, 108, 109, 110, 111, 117, 123, 128, 129, 138, 139, 147, 148, 150, 155, 166, 168, 169, 177, 179, 180, 181, 183, 185, 191:1, 191, 192, 193, and 199. Dye-based yellow colorants can be exemplified by C. I. Solvent Yellow 33, 56, 79, 82, 93, 112, 162, and 163 and C. I. Disperse Yellow 42, 64, 201, and 211.

Condensed azo compounds, diketopyrrolopyrrole compounds, anthraquinone, quinacridone compounds, basic dye lake compounds, naphthol compounds, benzimidazolone compounds, thioindigo compounds, and perylene compounds may be used as the magenta colorant. Specific examples are C. I. Pigment Red 2, 3, 5, 6, 7, 23, 48:2, 48:3, 48:4, 57:1, 81:1, 122, 146, 150, 166, 169, 177, 184, 185, 202, 206, 220, 221, 238, 254, and 269 and C. I. Pigment Violet 19.

Phthalocyanine compounds and derivatives thereof, anthraquinone compounds, and basic dye lake compounds can be used as the cyan colorant. Specific examples are C. I. Pigment Blue 1, 7, 15, 15:1, 15:2, 15:3, 15:4, 60, 62, and 66.

A single colorant or a mixture of colorants may be used, and the colorant can be used in the form of a solid solution. In the present invention, the colorant is selected considering the hue angle, chroma, lightness, lightfastness, OHT transparency, and dispersibility in the toner. The amount of addition of the colorant is preferably at least 1.0 mass parts and not more than 20.0 mass parts per 100.0 mass parts of the binder resin.

(Release Agent)

The wax in the present invention preferably contains a wax A that is a hydrocarbon wax and a wax B that is an ester wax.

Known waxes can be used without particular limitation as the wax A as long as they are hydrocarbon waxes. Examples are as follows: aliphatic hydrocarbon waxes such as low molecular weight polyethylene, low molecular weight polypropylene, microcrystalline waxes, paraffin waxes, and Fischer-Tropsch waxes; oxides of aliphatic hydrocarbon waxes, such as oxidized polyethylene wax, and their block copolymers; and waxes provided by grafting an aliphatic hydrocarbon wax using a vinyl monomer, e.g., styrene or acrylic acid.

Known waxes can be used without particular limitation as the wax B as long as they are ester waxes. Examples here are the ester waxes obtained from combinations of the following carboxylic acids and alcohols. The carboxylic acid can be exemplified by myristic acid, palmitic acid, stearic acid, arachidic acid, behenic acid, lignoceric acid, cerotic acid, montanic acid, melissic acid, oleic acid, vaccenic acid, linoleic acid, and linolenic acid. Dibasic carboxylic acids can be exemplified by butanedioic acid (succinic acid), pentanedioic acid (glutaric acid), hexanedioic acid (adipic acid), heptanedioic acid (pimelic acid), octanedioic acid (suberic acid), nonanedioic acid (azelaic acid), decanedioic acid (sebacic acid), dodecanedioic acid, phthalic acid, isophthalic acid, and terephthalic acid. Tribasic and higher basic carboxylic acids can be exemplified by trimellitic acid and pyromellitic acid.

The aliphatic alcohol, on the other hand, can be exemplified by myristyl alcohol, cetanol, stearyl alcohol, arachidyl alcohol, behenyl alcohol, tetracosanol, hexacosanol, octacosanol, and triacontanol. Dihydric alcohols can be exemplified by ethylene glycol, propylene glycol, 1,3-propanediol, 1,4-butanediol, 1,5-pentanediol, 1,6-hexanediol, 1,10-decanediol, 1,12-dodecanediol, 1,14-tetradecanediol, 1,16-hexadecanediol, 1,18-octadecanediol, 1,20-eicosanediol, 1,30-triacontanediol, diethylene glycol, dipropylene glycol, 2,2,4-trimethyl-1,3-pentanediol, neopentyl glycol, 1,4-cyclohexanedimethanol, spiroglycol, 1,4-phenylene glycol, bisphenol A, and hydrogenated bisphenol A. Trihydric and higher hydric alcohols can be exemplified by glycerol, trimethylolpropane, pentaerythritol, dipentaerythritol, diglycerol, and triglycerol.

Among the ester waxes that may be obtained from combinations of the preceding, aliphatic acid esters of pentaerythritol and aliphatic acid esters of dipentaerythritol are preferred for the wax incorporated in the toner of the present invention, while aliphatic acid esters of dipentaerythritol are more preferred. In addition, the esters of pentaerythritol and an aliphatic monocarboxylic acid and the esters of dipentaerythritol and an aliphatic monocarboxylic acid are preferred, and the esters of dipentaerythritol and an aliphatic monocarboxylic acid are particularly preferred.

The wax A and wax B are each preferably used at at least 0.5 mass parts and not more than 15.0 mass parts per 100.0 mass parts of the binder resin. The content ratio between the wax A and the wax B is preferably a (wax A/wax B) of at least 1/2 and not more than 4/1. The melting points of the wax A and wax B used in the present invention are preferably in the range of at least 30° C. and not more than 130° C. and are more preferably in the range of at least 60° C. and not more than 100° C. By using waxes that exhibit these thermal characteristics, not only does the obtained toner have an excellent fixing performance, but the wax-mediated releasing effect is very efficiently expressed.

The toner of the present invention may contain other ester waxes or other waxes.

(Charge Control Agent)

The toner particle of the present invention may use a charge control agent. Among charge control agents, the use is preferred of a charge control agent that controls the toner particle to a negative charging behavior. The charge control agent can be exemplified by the following:

organometal compounds, chelate compounds, monoazo metal compounds, acetylacetone-metal compounds, urea derivatives, metal-containing salicylic acid compounds, metal-containing naphthoic acid compounds, quaternary ammonium salts, calixarene, silicon compounds, and nonmetal carboxylic acid compounds and their derivatives. In addition, sulfonic acid resins bearing the sulfonic acid group, sulfonate salt group, or sulfonate ester group can preferably be used. The amount of addition of the charge control agent, expressed per 100.00 mass parts of the binder resin, is preferably at least 0.01 mass parts and not more than 20.00 mass parts and is more preferably at least 0.50 mass parts and not more than 10.00 mass parts.

(Polar Resin)

A polar resin can also be added to the toner of the present invention. Polyester resin is preferred for the polar resin. Moreover, the polyester resin more preferably contains at least 0.10 mol % and not more than 20.00 mol % of an isosorbide-derived unit (isosorbide unit) with reference to the total monomer units used in the polyester resin. The polarity of the polyester resin is strengthened by the incorporation of the isosorbide unit, and, when the toner is produced in an aqueous medium by a suspension polymerization method or a solution suspension method, a more robust shell can then be produced. As a result, a strong trend of inhibiting the surface exposure of the wax is assumed, even for a state in which the wax is present in the vicinity of the surface.

An polyester resin containing isosorbide unit uses isosorbide for the alcohol component, but may also use the following in combination therewith as an additional alcohol component.

Dihydric alcohol components can be exemplified by alkylene oxide adducts on bisphenol A, e.g., polyoxypropylene (2.2)-2,2-bis(4-hydroxyphenyl)propane, polyoxypropylene (3.3)-2,2-bis(4-hydroxyphenyl)propane, polyoxyethylene (2.0)-2,2-bis(4-hydroxyphenyl)propane, polyoxypropylene (2.0)-polyoxyethylene(2.0)-2,2-bis(4-hydroxyphenyl) propane, and polyoxypropylene(6)-2,2-bis(4-hydroxyphenyl)propane; aliphatic diols such as ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, and polytetramethylene glycol; and bisphenol A's such as bisphenol A and hydrogenated bisphenol A.

Trihydric and higher hydric alcohol components can be exemplified by sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene.

The acid component used to form the polyester resin can be exemplified by the following:

aromatic polybasic carboxylic acids such as phthalic acid, isophthalic acid, terephthalic acid, trimellitic acid, and pyromellitic acid; aliphatic polybasic carboxylic acids such as fumaric acid, maleic acid, adipic acid, and succinic acid and succinic acid substituted by a $C_{1-20}$ alkyl group or a $C_{2-20}$ alkenyl group, e.g., dodecenylsuccinic acid and octenylsuccinic acid; and the anhydrides of these acids and the alkyl (1 to 8 carbons) esters of these acids.

Among the preceding, the use is preferred in particular of polyester resin obtained by the condensation polymerization of a bisphenol derivative for the alcohol component and a dibasic or higher basic carboxylic acid or anhydride or lower alkyl ester thereof for the acid component.

In the present invention, this polyester resin may be used in combination with a heretofore known polyester resin.

The acid value of the polyester resin used in the present invention is preferably at least 0.5 mg KOH/g and not more than 25.0 mg KOH/g. An excellent durability of the developing performance and an excellent charging performance are readily obtained when the acid value is in the indicated range. It is thought that such an optimal range exists based on a balance between the encapsulation of the wax by the polyester resin A and the charging performance as mediated by the hygroscopicity.

In particular, the added polyester resin forms a shell at the toner particle surface through granulation in an aqueous medium. The functional effects of the present invention are even more readily expressed by having the acid value of the polyester resin be in the indicated range, and this is thus preferred.

The content of the polar resin is preferably at least 1.0 mass parts and not more than 20.0 mass parts per 100.0 mass parts of the binder resin.

(Production Method)

The method of producing the toner of the present invention is described in the following.

The method of producing the toner of the present invention can be exemplified by methods in which the toner is obtained by a pulverization method, suspension polymerization method, dispersion polymerization method, or a suspension granulation method in which the toner is made by carrying out the granulation, in an aqueous medium, of a solution•dispersion of the starting materials in an organic solvent. Toner production by the suspension polymerization method is particularly preferred because the production step is simple in this case and the intended toner is easily obtained. In addition, as compared to a pulverization method, exposure of the wax at the toner surface is suppressed and as a consequence a toner that provides an excellent image quality is obtained, and the suspension polymerization method is thus preferred.

In toner particle production by the suspension polymerization method, a polymerizable monomer composition is produced by dissolving or dispersing the following to uniformity using, for example, a stirrer: polymerizable monomer, wax, and as necessary other additives such as the resin A, colorant, and so forth. The colorant may be used by preliminarily dissolving/mixing or dispersing the colorant to uniformity, using, for example, a stirrer, in the polymerizable monomer that will constitute the binder resin. In particular, when the colorant is a pigment, it is preferably made into a pigment dispersion paste by treatment with a dispersing device.

The thusly obtained polymerizable monomer composition is added to a dispersion medium (preferably an aqueous medium) that contains a dispersion stabilizer and, using a high-speed dispersing device such as a high-speed stirrer or ultrasonic disperser as the stirring device, is microfinely dispersed until the toner particle diameter is achieved to form particles of the polymerizable monomer composition (granulation step). Toner particles can be obtained by carrying out a polymerization reaction under the application of light and/or heat on the polymerizable monomer present in the polymerizable monomer composition particles that have been microfinely dispersed in the granulation step (polymerization step). A polymerization initiator may be added after the granulation step.

A known method can be used for the method of dispersing the pigment in an organic medium. For example, as necessary a resin and a pigment dispersing agent are dissolved in the organic medium and the pigment powder is gradually added with stirring and is thoroughly blended into the solvent. The pigment can be stably and microfinely dispersed, i.e., can be dispersed into a uniform microparticulate form, by the application of a mechanical sheer force using a dispersing device such as a ball mill, paint shaker, dissolver, attritor, sand mill, high-speed mill, and so forth.

The same polymerizable monomer as used for the binder resin as described above can be used as polymerizable monomer that can be advantageously used in the suspension polymerization method.

The dispersion medium usable in the suspension polymerization method is determined based on the solubility in the dispersion medium of the polymerizable monomer, wax, resin A, and so forth, but an aqueous dispersion medium is preferred. Usable aqueous dispersion media can be exemplified by the following: water; alcohols such as methyl alcohol, ethyl alcohol, denatured ethyl alcohol, isopropyl alcohol, n-butyl alcohol, isobutyl alcohol, tert-butyl alcohol, and sec-butyl alcohol; and ether alcohols such as methyl cellosolve, cellosolve, isopropyl cellosolve, butyl cellosolve, and diethylene glycol monobutyl ether. Water-soluble dispersion media other than the preceding can be selected from ketones such as acetone, methyl ethyl ketone, and methyl isobutyl ketone; esters such as ethyl acetate; ethers such as ethyl ether; acetals such as methylal and diethyl acetal; and acids such as formic acid, acetic acid, and propionic acid; however, water or an alcohol is particularly preferred. A mixture of two or more of these solvents may also be used. The concentration of the polymerizable monomer composition with reference to the dispersion medium, expressed with reference to the dispersion medium, is preferably at least 1.0 mass % and not more than 80.0 mass % and more preferably at least 10.0 mass % and not more than 65.0 mass %.

Known dispersion stabilizers can be used as the dispersion stabilizer usable when an aqueous dispersion medium is used. Specific examples of inorganic compounds are calcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica, and alumina. With regard to organic compounds, the following can be used dispersed in an aqueous phase: polyvinyl alcohol, gelatin, methyl cellulose, methyl hydroxypropyl cellulose, ethyl cellulose, the sodium salt of carboxymethyl cellulose, polyacrylic acid and its salts, starch and the like. The concentration of the dispersion stabilizer is preferably at least 0.2 mass parts and not more than 20.0 mass parts per 100.0 mass parts of the polymerizable monomer composition.

The same polymerization initiators as described above can be used as the polymerization initiator used in the suspension polymerization method used for the toner of the present invention.

A known crosslinking agent may be added when the toner is produced by the suspension polymerization method.

(External Additive)

The toner of the present invention preferably has an inorganic fine powder on the toner particle surface. This inorganic fine powder is added to and mixed with the toner particle in order to improve the flowability of the toner and make its charging uniform, and the added inorganic fine powder is present uniformly attached to the toner particle surface.

The inorganic fine powder in the present invention preferably has a number-average primary particle diameter (D1) of at least 4 nm and not more than 500 nm.

An inorganic fine powder selected from silica, alumina, and titania, or a composite oxide thereof, or the like can be used as the inorganic fine powder used in the present invention. The composite oxide can be exemplified by silica-aluminum fine powder and strontium titanate fine powder. These inorganic fine powders are preferably used after their surface has been subjected to a hydrophobic treatment.

Other additives may also be added to the toner used in the present invention in small amounts as developing performance improving agents within a range that substantially does not impart adverse effects, for example, lubricant powders such as Teflon® powder, zinc stearate powder, and polyvinylidene fluoride powder; or abrasives such as cerium oxide powder, silicon carbide powder, and strontium titanate powder; or, for example, flowability-imparting agents such as titanium oxide powder and aluminum oxide powder; anticaking agents; and reverse polarity organic and/or inorganic finely divided particles. These additives may also be used after the execution of a hydrophobic treatment on the surface thereof.

The amount of addition for the inorganic fine powder and/or additives, expressed per 100.0 mass parts of the toner particle, is preferably at least 0.01 mass parts and not more than 8.00 mass parts and more preferably at least 0.10 mass parts and not more than 4.00 mass parts.

The methods for measuring the various property values stipulated for the present invention are described in the following.

<Observation of the Cross Section with a Transmission Electron Microscope (TEM)>

The internal structure of the toner can be observed with a transmission electron microscope (TEM) proceeding as follows.

First, the toner is dispersed onto a cover glass (Matsunami Glass Ind., Ltd., Square Cover Glass No. 1) so as to provide a single layer, and an Os film (5 nm) and a naphthalene film (20 nm) are formed as protective films using an osmium plasma coater (OPC80T, Filgen, Inc.). Then, D800 photocurable resin (JEOL Ltd.) is filled into a hollow PTFE tube (Φ3 mm×3 mm) and the cover glass is gently placed over the tube oriented so the toner is in contact with the D800 photocurable resin. Exposure to light is carried out while in this configuration and the resin is cured, after which the cover glass is removed from the tube to give a cylindrical sample having the toner embedded in the surfacemost layer.

Using an ultrasound ultramicrotome (UC7, Leica), slices of 100 nm each are repetitively taken from the surfacemost layer of the cylindrical sample at a slicing rate of 0.6 mm/s until the toner surface appears. After the toner surface appears, 100 nm-thick samples are repeatedly sliced off to form a plurality of thin-slice samples. During this, sequence numbers are assigned to the thin-slice samples in the order in which they are sliced off. Using a vacuum electronic staining device (VSC4R1H, Filgen, Inc.), the obtained thin-slice samples are stained for 15 minutes in a 500 Pa $RuO_4$ gas atmosphere, and TEM observation is carried out in numerical sequence using a transmission electron microscope TEM (JEM2800, JEOL Ltd.).

Imaging is carried out at a TEM acceleration voltage of 200 kV, a probe size of 1 nm, and an image size of 1024×1024 pixels. For the imaging, on the Detector Control panel for the bright-field image, the Contrast was adjusted to 1620 and the Brightness was adjusted to 2785; on the Image Control panel, the Contrast was set to 0.0, the Brightness was set to 0.5, and the Gamma was set to 1.00.

<Measurement of the Size, Shape, and Position of the Wax Domains in the Toner>

Measurement of the size, shape, and position of the wax domains in the toner is carried out after the images (bright-field image) provided by the TEM observation have been processed using "Avizo ver. 7.1" (VSG, Inc.) 3D-visualization software into images that support three-dimensional analysis.

First, the TEM images are imported in the thin-slice sample sequence and binarization is carried out with the threshold value for the brightness (255 gradations) set to 160. When this is done, the wax in the toner and the D800 photocurable resin become bright areas and other than the wax in the toner becomes a dark area. The contour of the toner can be distinguished by the light-versus-darkness for the toner-versus-the D800 photocurable resin. An image that supports three-dimensional analysis is obtained by connecting, in the direction orthogonal to the TEM images of the toner, these individual binarized images. The wax domain having the largest major axis length is selected from the obtained three-dimensional image; the major axis length and minor axis length of the domain are measured; and the ratio between the major axis length and minor axis length is measured. The shortest distance of the domain from the toner surface is also measured.

In the present invention, the three-dimensional analysis is carried out on 100 toner particles for which the major axis length of the measured toner particle is at least 0.8-times and not more than 1.2-times the number-average particle diameter (D1) of the toner particles, and the distribution of the shortest distance between the wax domain and the toner particle surface is determined from the data for the 100. In addition, the domain shape is taken to be the value of the arithmetic mean of the data for the 100.

<Method for Measuring the Number-Average Particle Diameter D of the Toner>

The number-average particle diameter D of the toner is determined as follows. The measurement instrument used is a "Coulter Counter Multisizer 3®" (Beckman Coulter, Inc.), a precision particle size distribution measurement instrument operating on the pore electrical resistance method and equipped with a 100 μm aperture tube. The measurement conditions are set and the measurement data are analyzed using the accompanying dedicated software, i.e., "Beckman Coulter Multisizer 3 Version 3.51" (Beckman Coulter, Inc.). The measurements are carried at 25,000 channels for the number of effective measurement channels.

The aqueous electrolyte solution used for the measurements is prepared by dissolving special-grade sodium chloride in ion-exchanged water to provide a concentration of 1 mass % and, for example, "ISOTON II" (Beckman Coulter, Inc.) can be used.

The dedicated software is configured as follows prior to measurement and analysis. In the "modify the standard operating method (SOM)" screen in the dedicated software, the total count number in the control mode is set to 50,000 particles; the number of measurements is set to 1 time; and the Kd value is set to the value obtained using "standard particle 10.0 μm" (Beckman Coulter, Inc.). The threshold value and noise level are automatically set by pressing the "threshold value/noise level measurement button". In addition, the current is set to 1600 μA; the gain is set to 2; the electrolyte is set to ISOTON II; and a check is entered for the "post-measurement aperture tube flush". In the "setting conversion from pulses to particle diameter" screen of the dedicated software, the bin interval is set to logarithmic particle diameter; the particle diameter bin is set to 256 particle diameter bins; and the particle diameter range is set to 2 μm to 60 μm.

The specific measurement procedure is as follows.

(1) 200 mL of the aqueous electrolyte solution is introduced into a 250-mL roundbottom glass beaker intended for use with the Multisizer 3 and this is placed in the sample stand and counterclockwise stirring with the stirrer rod is carried out at 24 rotations per second. Contamination and air bubbles within the aperture tube are preliminarily removed by the "aperture flush" function of the dedicated software.

(2) 30 mL of the aqueous electrolyte solution is introduced into a 100-mL flatbottom glass beaker. To this is added as dispersing agent 0.3 mL of a dilution prepared by the three-fold (mass) dilution with ion-exchanged water of "Contaminon N" (a 10 mass % aqueous solution of a neutral pH 7 detergent for cleaning precision measurement instrumentation, comprising a nonionic surfactant, anionic surfactant, and organic builder, Wako Pure Chemical Industries, Ltd.).

(3) An "Ultrasonic Dispersion System Tetora 150" (Nikkaki Bios Co., Ltd.) is prepared; this is an ultrasound disperser with an electrical output of 120 W and is equipped with two oscillators (oscillation frequency=50 kHz) disposed such that the phases are displaced by 180°. 3.3 L of ion-exchanged water is introduced into the water tank of the ultrasound disperser and 2 mL of Contaminon N is added to this water tank.

(4) The beaker described in (2) is set into the beaker holder opening on the ultrasound disperser and the ultrasound disperser is started. The vertical position of the beaker is adjusted in such a manner that the resonance condition of the surface of the aqueous electrolyte solution within the beaker is at a maximum.

(5) While the aqueous electrolyte solution within the beaker set up according to (4) is being irradiated with ultrasound, 10 mg of the toner is added to the aqueous electrolyte solution in small aliquots and dispersion is carried out. The ultrasound dispersion treatment is continued for an additional 60 seconds. The water temperature in the water tank is controlled as appropriate during ultrasound dispersion to be at least 10° C. and not more than 40° C.

(6) Using a pipette, the dispersed toner-containing aqueous electrolyte solution prepared in (5) is dripped into the roundbottom beaker set in the sample stand as described in (1) with adjustment to provide a measurement concentration of 5%. Measurement is then performed until the number of measured particles reaches 50,000.

(7) The measurement data is analyzed by the dedicated software provided with the instrument and the number-average particle diameter D is calculated. When set to graph/number % with the dedicated software, the "average diameter" on the "analysis/numerical statistical value (arithmetic mean)" screen is the number-average particle diameter D.

<Method for Measuring the SP Value of the Wax A (SPa) and the Wax B (SPb)>

The SP value $(cal/cm^3)^{1/2}$ in this Specification can be calculated using Fedors' method. Specifically, the SP value can be calculated, for example, using the following formula, which is described in detail in Polymer Engineering and Science, Volume 14, pp. 147-154.

$$SP\ \text{value}=(Ev/v)^{1/2}=(\Sigma\Delta ei/\Sigma\Delta vi)^{1/2} \quad \text{formula}$$

(in the formula, Ev: energy of vaporization (cal/mol), v: molar volume ($cm^3$/mol), Δei: energy of vaporization of the individual atoms or atomic groups, Δvi: molar volume of the individual atoms or atomic groups)

<Compositional Analysis of the Resin A, Wax A, and Wax B>

Compositional analysis of the resin A, wax A, and wax B can be carried out using nuclear magnetic resonance instrumentation ($^1$H-NMR, $^{13}$C-NMR) and the FT-IR spectra. The instrumentation is described in the following.

Each of the resin samples may be acquired by fractionation from the toner and may then be submitted to analysis.

(i) $^1$H-NMR, $^{13}$C-NMR measurement instrumentation: JNM-EX400 FT-NMR instrument (JEOL Ltd.)

measurement frequency: 400 MHz pulse condition: 5.0 μs frequency range: 10500 Hz number of integrations: 64

(ii) FT-IR Spectra

AVATAR360 FT-IR from Thermo Fisher Scientific Inc.

<Method for Measuring the Acid Value of the Resin A and the Polar Resin>

The acid value of the resin A and the polar resin is measured in accordance with JIS K 1557-1970. The specific measurement method is described in the following.

2 g of the pulverized sample is exactly weighed (W (g)). The sample is introduced into a 200-mL Erlenmeyer flask; 100 mL of a toluene/ethanol (2:1) mixed solvent is added; and dissolution is carried out for 5 hours. A phenolphthalein solution is added as indicator. The solution is titrated using a burette and using a standard 0.1 mol/L alcoholic KOH solution. The amount of KOH solution used here is designated S (mL). A blank test is performed and the amount of KOH solution used in this case is designated B (mL).

The acid value is calculated using the following formula. The "f" in the formula is the factor for the KOH solution.

$$\text{acid value (mg KOH/g)}=[(S-B)\times f\times 5.61]/W$$

<Method for Measuring the Weight-Average Molecular Weight (Mw) of the Resin A and the Polar Resin>

The weight-average molecular weight (Mw) of the resin A and the polar resin is measured using gel permeation chromatography (GPC) as follows.

First, the particular resin is dissolved in tetrahydrofuran (THF) at room temperature. The obtained solution is filtered with a "Sample Pretreatment Cartridge" (Tosoh Corporation) solvent-resistant membrane filter having a pore diameter of 0.2 μm to obtain a sample solution. The sample solution is adjusted to a concentration of THF-soluble component of 0.8 mass %. Measurement is carried out under the following conditions using this sample solution.

instrument: "HLC-8220GPC" high-performance GPC instrument [Tosoh Corporation]

column: 2×LF-604 [Showa Denko K.K.]

eluent: THF flow rate: 0.6 mL/min oven temperature: 40° C.

sample injection amount: 0.020 mL

A molecular weight calibration curve constructed using polystyrene resin standards (for example, product name "TSK Standard Polystyrene F-850, F-450, F-288, F-128, F-80, F-40, F-20, F-10, F-4, F-2, F-1, A-5000, A-2500, A-1000, A-500", Tosoh Corporation) is used to determine the molecular weight of the sample.

<Method for Measuring the Melting Point Tm (° C.) of the Waxes (Wax A, Wax B)>

The melting point Tm (° C.) of the waxes is measured according to ASTM D 3418-82 using a "Q1000" differential scanning calorimeter (TA Instruments). Temperature correction in the instrument detection section is carried out using the melting points of indium and zinc, and correction of the amount of heat is carried out using the heat of fusion of indium. Specifically, 2 mg of the measurement sample is exactly weighed and is introduced into an aluminum pan. Using an empty aluminum pan for reference, the temperature is raised at a ramp rate of 10° C./minute in the measurement range between 0° C. and 120° C. Holding is carried out for 15 minutes at 100° C. followed by cooling from 100° C. to 0° C. at a ramp down rate of 10° C./minute. Holding at 0° C. is carried out for 10 minutes followed by performing the measurement at a ramp rate of 10° C./minute between 0° C. and 100° C. The melting point Tm (° C.) is taken to be the peak value in the endothermic curve in this second heating process.

EXAMPLES

The present invention is specifically described below using examples, but the present invention is not limited to or by these examples. The "parts" used in the examples indicates "mass parts" in all instances.

<Waxes>

A Fischer-Tropsch wax (melting point: 78° C., SPa: 8.30) was prepared as the wax A.

The waxes in the following Table 1 were prepared for the wax B.

TABLE 1

| Wax B | Type | Starting alcohol | Starting aliphatic acid | SPb |
|---|---|---|---|---|
| Wax B1 | Dipentaerythritol hexastearate | Dipentaerythritol | Stearic acid | 8.97 |
| Wax B2 | Dipentaerythritol hexabehenate | Dipentaerythritol | Behenic acid | 8.90 |
| Wax B3 | Pentaerythritol tetrabehenate | Pentaerythritol | Behenic acid | 8.94 |
| Wax B4 | Glycerol tristearate | 1,2,3-propanetriol | Stearic acid | 8.91 |
| Wax B5 | Stearyl stearate | Stearyl alcohol | Stearic acid | 8.59 |

Resin A Production Example

Polymerizable Monomer A1 Production Example 18 g of 2,4-dihydroxybenzoic acid was dissolved in 150 mL of methanol. 36.9 g of potassium carbonate was added to this solution and heating to 65° C. was carried out. A solution was prepared by mixing and dissolving 18.7 g of 4-(chloromethyl)styrene in 100 mL of methanol, and this was added dropwise to the solution containing the salicylic acid intermediate and a reaction was run for 3 hours at 65° C. After the obtained reaction solution had been cooled, it was filtered and the methanol in the filtrate was distilled off under reduced pressure to produce a precipitate. The precipitate was dispersed in 1.50 L of water having pH=2 and ethyl acetate was added to perform extraction. This was followed by washing with water and then drying over magnesium sulfate and distillation of the ethyl acetate under reduced pressure to obtain a precipitate. The precipitate was washed with hexane and recrystallized from toluene/ethyl acetate to obtain 20.1 g of the polymerizable monomer A1 having the structure given in formula (5) below.

[C5]

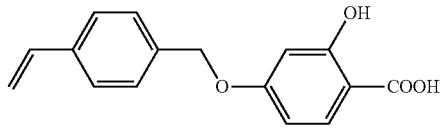

(5)

Resin A1 Production Example

The polymerizable monomer A1 (12.0 parts) and styrene (88.0 parts) were dissolved in 40.0 mL of DMF and were stirred for 1 hour and then heated to 110° C. To this reaction solution was added dropwise a solution obtained by stirring for 1 hour the solution provided by introducing 3.40 parts of tert-butylperoxy isopropyl monocarbonate (product name: Perbutyl I, NOF Corporation.) into 40.0 mL of toluene. The reaction was carried out for an additional 4 hours at 110° C. under nitrogen introduction. This was followed by cooling and dropwise addition to 1.00 L of methanol to obtain a precipitate. The obtained precipitate was dissolved in 120.0 mL of THF; 1.80 L of methanol was then added dropwise to precipitate a white precipitate; and filtration and drying at 90° C. under reduced pressure then yielded a resin A1 obtained from styrene and the polymerizable monomer A1. Compositional analysis of the obtained resin A1 was performed by $^1$H-NMR as described above and confirmed that the polymerizable monomer A1 had undergone polymerization. In addition, the acid value of resin A1 was 24.9 mg KOH/g, and it was thus confirmed from the acid value that the formula (2) segment derived from the polymerizable monomer A1 was contained at 44.4 μmol/g. The charge amounts and properties for resin A1 are given in Table 2.

TABLE 2

| Resin A | | Resin A1 |
|---|---|---|
| Polymerizable monomer designation | | Polymerizable monomer A1 |
| Charge amount (g) | Polymerizable monomer | 12.0 |
| | Styrene | 88.00 |
| | 2-EHA | 0.00 |
| | Initiator | 3.40 |
| Reaction temperature (° C.) | | 110 |
| Reaction time (h) | | 4.0 |
| Acid value of the resin (mg KOH/g) | | 24.9 |
| Molecular weight | Mw | 26500 |
| | Mw/Mn | 2.2 |

<Production of Polar Resin B1>

100.0 parts of a mixture provided by mixing the starting monomers other than the trimellitic anhydride in the molar ratios given in Table 3 was added to a reactor equipped with a stirrer, thermometer, nitrogen introduction line, water separator, and apparatus for reducing the pressure, and heating to a temperature of 130° C. was carried out while stirring. Then, 0.52 parts of tin di(2-ethylhexanoate) was added as esterification catalyst; heating was carried out to a temperature of 200° C.; and a condensation polymerization was run for 6 hours. Trimellitic anhydride was added in the molar ratio shown in Table 3; introduction to a polymerization tank equipped with a nitrogen introduction line, water separation line, and stirrer was performed; and a condensation reaction was run under a reduced pressure of 40 kPa until the desired molecular weight was reached, thus obtaining a polar resin B1.

<Production of Polar Resins B2 and B3>

Polar resins B2 and B3 were produced, proceeding as for polar resin B1, using the starting monomer charge amounts and temperature conditions during the polycondensation reaction in Table 3.

TABLE 3

| | | | Polar resin B1 | Polar resin B2 | Polar resin B3 |
|---|---|---|---|---|---|
| Monomer composition | Acid | TPA [mol ratio] | 90.0 | 90.0 | 85.0 |
| | | IPA [mol ratio] | 0.0 | 0.0 | 5.0 |
| | | TMA [mol ratio] | 5.0 | 5.0 | 5.0 |
| | Alcohol | BPA(PO) [mol ratio] | 60.0 | 60.0 | 55.0 |
| | | BPA(EO) [mol ratio] | 0.0 | 0.0 | 5.0 |
| | | Isosorbide [mol ratio] | 13.6 | 0.2 | 0.0 |
| | | EG [mol ratio] | 26.4 | 39.8 | 40.0 |
| Condensation temperature (° C.) | | | 200.0 | 200.0 | 200.0 |
| Properties | mol % of isosorbide in resin | | 7.0 | 0.1 | 0.0 |
| | Glass transition temperature | | 72.0 | 51.5 | 57.0 |
| | Acid value | | 5.0 | 6.0 | 6.0 |
| | Weight-average molecular weight (Mw) | | 16000 | 16000 | 15000 |

The isosorbide referenced in the table is a compound having the structure with the following formula (6).

[C6]

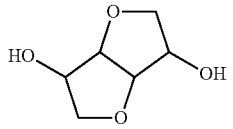

(6)

In the table, TPA indicates terephthalic acid; IPA indicates isophthalic acid; TMA indicates trimellitic anhydride; BPA (PO) indicates an adduct of 2 mol propylene oxide on bisphenol A; BPA(EO) indicates an adduct of 2 mol ethylene oxide on bisphenol A; and EG indicates ethylene glycol.

Toner Production Example 1

(Dispersion Medium)

14.0 mass parts of sodium phosphate and 4.5 mass parts of 10.0% hydrochloric acid were introduced into 1000.0 mass parts of deionized water in a reactor, and the temperature was held at 65° C. for 60 minutes while carrying out an $N_2$ purge. While stirring at 12,000 rpm using a T. K. Homomixer (Tokushu Kika Kogyo Co., Ltd.), an aqueous calcium chloride solution, prepared by the dissolution of 8.0 mass parts of calcium chloride in 10.0 mass parts of deionized water, was introduced all at once to prepare an aqueous medium containing a dispersion stabilizer. The pH of the prepared aqueous medium was 5.5.

(Polymerizable Monomer Composition)

| | |
|---|---|
| styrene | 60.0 mass parts |
| Pigment Blue 15:3 | 6.0 mass parts |
| Bontron E-88 charge control agent (Orient Chemical Industries Co., Ltd.) | 1.0 mass parts |

These materials were introduced into an attritor (Mitsui Miike Chemical Engineering Machinery, Co., Ltd.) and were dispersed for 5 hours at 220 rpm using zirconia particles having a diameter of 1.7 ram to obtain a polymerizable monomer composition.

The following were added to this polymerizable monomer composition.

| | |
|---|---|
| styrene | 15.0 mass parts |
| n-butyl acrylate | 25.0 mass parts |
| wax A | 5.0 mass parts |
| wax B1 | 5.0 mass parts |
| resin A1 | 1.0 mass parts |
| polar resin B1 | 4.0 mass parts |

These materials were held at 65° C. in a separate container and were dissolved and dispersed to uniformity using a T. K. Homomixer (Tokushu Kika Kogyo Co., Ltd.) at 500 rpm. Into this, 11.0 mass parts of t-hexyl peroxypivalate (product name: "Perhexyl PV", NOF Corporation., molecular weight=202, 10-hour half-life temperature=53.2° C.) was dissolved to prepare a polymerizable monomer composition.

This polymerizable monomer composition was introduced into the aforementioned aqueous medium in the reactor, and granulation was carried out at pH 5.5 and 65° C. under an $N_2$ purge by stirring for 5 minutes at 10,000 rpm with a T. K. Homomixer (Tokushu Kika Kogyo Co., Ltd.). This was followed by reaction, while stirring with a paddle stirring blade, for 6 hours at 65° C. and then heating to 90° C. and reacting for 6 hours.

After the completion of the polymerization reaction, the reactor was cooled and, with the pH having been brought to 2 by the addition of 10.0% hydrochloric acid, the dispersion stabilizer was dissolved while stirring for 2 hours. This emulsion was subjected to pressure filtration and was additionally washed with at least 2,000 mass parts of deionized water. The obtained cake was re-introduced into 1000.0 mass parts of deionized water and, with the pH having been brought to 1 or below by the addition of 10.0% hydrochloric acid, a rewashing was carried out while stirring for 2 hours. Proceeding as above, the emulsion was subjected to pressure filtration and was washed with at least 2000.0 mass parts of deionized water and, after a thorough ventilation, was dried and subjected to air classification to obtain a toner particle 1.

The following were added to 100.0 mass parts of toner particle 1 as external additives: 1.5 mass parts of a hydrophobic silica fine powder (primary particle diameter=7 nm, BET specific surface area=130 $m^2/g$) provided by treatment with 20.0 mass % dimethylsilicone oil with reference to the silica fine powder prior to the treatment, and 0.3 mass parts of a hydrophobic titanium oxide fine powder (primary particle diameter=50 nm) provided by treatment of the surface with 15.0 mass % isobutyltrimethoxysilane. This was mixed for 15 minutes at a stirring rate of 3,000 rpm using a Mitsui Henschel mixer (Mitsui Miike Chemical Engineering Machinery, Co., Ltd.) to obtain a toner 1. The obtained toner 1 had a number-average particle diameter of 6.5 μm.

Toner Production Examples 2 to 4

Toners 2 to 4 were obtained by the same method as in Toner Production Example 1, but changing the C. I. Pigment Blue 15:3 to C. I. Pigment Yellow 93, C. I. Pigment Red 269, and carbon black, respectively.

Toner Production Examples 5 to 19

Toners 5 to 19 were obtained proceeding as in the toner 1 production method, but changing the type and content of the wax, the content of resin A, and the type and content of polar resin B as shown in Table 4.

TABLE 4

| | | Wax A | | Wax B | | Resin A | Polar resin B | |
|---|---|---|---|---|---|---|---|---|
| Toner No. | Polymerizable monomer | Type | Content (mass parts) | Type | Content (mass parts) | Content (mass parts) | Type | Content (mass parts) |
| 1 | St/n-BA | Wax A | 5.0 | Wax B1 | 5.0 | 1.0 | B1 | 4.0 |
| 5 | St/n-BA | Wax A | 5.0 | Wax B2 | 5.0 | 1.0 | B1 | 4.0 |
| 6 | St/n-BA | Wax A | 3.0 | Wax B2 | 3.0 | 1.0 | B1 | 4.0 |
| 7 | St/n-BA | Wax A | 7.0 | Wax B2 | 7.0 | 1.0 | B1 | 4.0 |
| 8 | St/n-BA | Wax A | 5.0 | Wax B3 | 5.0 | 1.0 | B1 | 4.0 |
| 9 | St/n-BA | Wax A | 3.0 | Wax B3 | 3.0 | 1.0 | B1 | 4.0 |
| 10 | St/n-BA | Wax A | 7.0 | Wax B3 | 7.0 | 1.0 | B1 | 4.0 |
| 11 | St/n-BA | Wax A | 5.0 | Wax B3 | 5.0 | 0.0 | B1 | 4.0 |
| 12 | St/n-BA | Wax A | 5.0 | Wax B2 | 5.0 | 0.0 | B1 | 4.0 |
| 13 | St/n-BA | Wax A | 7.0 | Wax B2 | 7.0 | 1.0 | B2 | 4.0 |
| 14 | St/n-BA | Wax A | 3.0 | Wax B3 | 2.0 | 1.0 | B1 | 4.0 |
| 15 | St/n-BA | Wax A | 8.0 | Wax B3 | 7.0 | 1.0 | B1 | 4.0 |
| 16 | St/n-BA | Wax A | 5.0 | Wax B4 | 5.0 | 0.0 | B2 | 4.0 |
| 17 | St/n-BA | Wax A | 5.0 | Wax B2 | 5.0 | 1.0 | B3 | 4.0 |
| 18 | St/n-BA | Wax A | 5.0 | Wax B5 | 5.0 | 0.0 | B1 | 4.0 |
| 19 | St/n-BA | — | — | Wax B2 | 9.0 | 1.0 | B1 | 4.0 |

In the table, St refers to styrene and n-BA refers to n-butyl acrylate.

Examples 1 to 14 and Comparative Examples 1 to 7

<Measurement of the Shape and Position of the Wax Domains in the Toner>

Using the methods described above, the number-average particle diameter of the toner, the major axis length and minor axis length of the wax domain, and the shortest distance between the toner particle surface and the wax domain were measured using each of the obtained toner particles. The results for toners 1 to 19 are given in Table 5.

TABLE 5

| | | Number-average particle diameter of the toner (D1) D(μm) | Major diameter of the wax domain d(μm) | d/D | Ratio between the major axis length and minor axis length of the wax Domain (major axis length/minor axis length) | Shortest distance between the toner particle surface and the Domain: Less than 50 nm (number %) | Shortest distance between the toner particle surface and the Domain: At least 50 nm and no more than 500 nm (number %) | SPb-SPa |
|---|---|---|---|---|---|---|---|---|
| Example 1 | Toner 1 | 6.5 | 2.3 | 0.35 | 1.5 | 0.0 | 90.0 | 0.67 |
| Example 2 | Toner 2 | 6.5 | 2.3 | 0.35 | 1.5 | 0.0 | 90.0 | 0.67 |
| Example 3 | Toner 3 | 6.5 | 2.3 | 0.35 | 1.5 | 0.0 | 90.0 | 0.67 |
| Example 4 | Toner 4 | 6.5 | 2.3 | 0.35 | 1.5 | 0.0 | 90.0 | 0.67 |
| Example 5 | Toner 5 | 6.5 | 2.6 | 0.40 | 1.3 | 4.0 | 86.0 | 0.60 |
| Example 6 | Toner 6 | 6.5 | 1.7 | 0.26 | 1.3 | 3.0 | 79.0 | 0.60 |
| Example 7 | Toner 7 | 6.5 | 3.2 | 0.49 | 1.3 | 5.0 | 90.0 | 0.60 |
| Example 8 | Toner 8 | 6.5 | 2.5 | 0.38 | 2.4 | 2.0 | 66.0 | 0.64 |
| Example 9 | Toner 9 | 6.5 | 1.7 | 0.26 | 2.5 | 1.0 | 69.0 | 0.64 |
| Example 10 | Toner 10 | 6.5 | 3.2 | 0.49 | 2.3 | 3.0 | 73.0 | 0.64 |
| Example 11 | Toner 11 | 6.5 | 2.5 | 0.38 | 2.4 | 0.0 | 62.0 | 0.64 |
| Example 12 | Toner 12 | 6.5 | 2.6 | 0.40 | 1.3 | 1.0 | 74.0 | 0.60 |
| Example 13 | Toner 13 | 6.5 | 3.2 | 0.49 | 1.3 | 10.0 | 90.0 | 0.60 |
| Comparative Example 1 | Toner 14 | 6.5 | 1.5 | 0.23 | 2.5 | 6.0 | 69.0 | 0.64 |
| Comparative Example 2 | Toner 15 | 6.5 | 3.5 | 0.54 | 2.3 | 3.0 | 73.0 | 0.64 |
| Comparative Example 3 | Toner 16 | 6.5 | 2.5 | 0.38 | 2.8 | 4.0 | 61.0 | 0.61 |
| Comparative Example 4 | Toner 17 | 6.5 | 3.2 | 0.49 | 1.3 | 13.0 | 87.0 | 0.60 |
| Comparative Example 5 | Toner 18 | 6.5 | 2.5 | 0.38 | 3.5 | 0.0 | 56.0 | 0.29 |
| Comparative Example 6 | Toner 19 | 6.5 | 2.5 | 0.38 | 1.4 | 0.0 | 40.0 | 0.60 |

Performance evaluations were performed on each of the obtained toners in accordance with the following methods.

[Evaluation (1): Evaluation of the Separation Behavior During Fixing]

A color laser printer (HP LaserJet Pro 400 Color M451dn, HP Development Company, L.P.) from which the fixing unit had been removed was prepared; the toner was removed from the cyan cartridge; and the toner to be evaluated was filled as a replacement. CS520 paper (Canon Inc., 52 g/m$^2$) was used as the recording medium.

Then, using the filled toner, a 5.0 cm long by 20.0 cm wide unfixed image was formed on the recording medium at a toner laid-on level of 0.90 mg/cm$^2$. Image formation was carried out here while changing the extent of the margin at the upper edge considered in the direction of paper transit.

The removed fixing unit was then modified so the fixation temperature and process speed could be adjusted and was used to conduct a fixing test on the unfixed images.

First, the unfixed images were fixed while operating in a normal temperature and normal humidity environment (23° C., 60% RH) with the process speed set to 230 mm/s and the lineal fixing pressure set to 27.4 kgf (242 N) and using 200° C. for the set temperature. The smallest margin at which the paper did not wrap around the fixing roller was evaluated according to the following criteria.

The results of the evaluation are given in Table 6.

(Evaluation Criteria)

A: The margin from the upper edge is less than 1 mm.

B: The margin from the upper edge is at least 1 mm and less than 3 mm.

C: The margin from the upper edge is at least 3 mm and less than 5 mm.

D: The margin from the upper edge is 5 mm or more.

[Evaluation (2): Evaluation of Development Stripes]

<Durability Test>

The evaluation was carried out using a modified HP LaserJet Pro 400 Color M451dn (HP Development Company, L.P.) as the image-forming apparatus. The HP LaserJet Pro 400 Color M451dn was modified as follows.

The process speed was made 150 mm/sec by modifying the gearing and software in the main unit of the machine used for the evaluation.

The cyan cartridge was used as the cartridge used for the evaluation. Thus, the product toner was extracted from the commercial cyan cartridge; the interior was cleaned with an air blower; and 50 g of the toner to be evaluated was then filled in. At the magenta, yellow, and black stations, the product toner was extracted in each case and the magenta, yellow, and black cartridges were inserted with the detection mechanism for the remaining amount of toner inactivated.

Operating at a high temperature and high humidity (30° C., 80% RH) and using Office Planner (64 g/m$^2$) from Canon Inc. as the image-receiving paper, 15,000 prints of an image having a 1.0% print percentage were output in an intermittent mode (in this mode, the developing device is stopped for 10 seconds each time an image is printed out and toner deterioration is thus accelerated due to the preliminary operation of the developing assembly during restart). After this output run, a halftone image was additionally output and the developing performance was evaluated as indicated below by checking for the presence/absence of image streaks in this halftone image and checking for the presence/absence of melt-adhered material on the developing roller.

The results of the evaluation are given in Table 6.

(Evaluation Criteria)

A: Vertical streaks in the discharge direction considered to be development stripes are seen neither on the developing roller nor on the image in the halftone region.

B: From 1 to 4 thin streaks are present on the developing roller, but vertical streaks in the discharge direction considered to be development stripes are not seen on the image in the halftone region.

C: From 5 to 9 thin streaks are present on the developing roller, but vertical streaks in the discharge direction considered to be development stripes are not seen on the image in the halftone region.

D: At least 10 streaks are on the developing roller, or visible development stripes are seen on the image in the halftone region.

[Evaluation (3): Evaluation of Toner Cracking and Chipping]

Output was performed at low temperature and low humidity (15° C., 10% RH) using Office Planner (64 g/m$^2$) from Canon Inc. as the image-receiving paper. A modified HP LaserJet Pro 400 Color M451dn (HP Development Company, L.P.) as described above in evaluation (2) was used as the image-forming device.

A durability evaluation was executed under these conditions at a print percentage of 0.0%; the presence/absence of the occurrence of toner leakage based on poor charging caused by cracked toner and chipped toner was checked; and an evaluation was performed in accordance with the criteria given below in correspondence to the number of prints produced. The mechanism by which toner leakage is produced through the production of poor charging caused by cracked toner and chipped toner, is as follows. When toner cracking and chipping occur, melt adhesion of the toner occurs at the contact zone between the toner bearing member and the toner layer thickness control member, and a satisfactory charging of the toner is impaired at the melt adhered part. The poorly charged toner exhibits a reduced retention at the surface of the toner bearing member and is scattered by the centrifugal force produced by rotation of the toner bearing member and leaks out from the cartridge gap to produce "toner leakage".

The results of the evaluation are given in Table 6.

A: the number of prints produced is at least 13,000

B: the number of prints produced is at least 10,000 and less than 13,000

C: the number of prints produced is at least 5,000 and less than 10,000

D: the number of prints produced is less than 5,000

TABLE 6

| | | Evaluation (1): separation behavior during fixing | | Evaluation (2): evaluation of development stripes | | Evaluation (3): evaluation of toner cracking and chipping | |
|---|---|---|---|---|---|---|---|
| | | Margin (mm) | Rank | Number of development stripes (no.) | Rank | Number of prints produced (no.) | Rank |
| Example 1 | Toner 1 | 0.0 | A | 0 | A | 13000 | A |
| Example 2 | Toner 2 | 0.0 | A | 0 | A | 13000 | A |
| Example 3 | Toner 3 | 0.0 | A | 0 | A | 13000 | A |
| Example 4 | Toner 4 | 0.0 | A | 0 | A | 13000 | A |
| Example 5 | Toner 5 | 0.5 | A | 4 | B | 14000 | A |
| Example 6 | Toner 6 | 2.8 | B | 3 | B | 16000 | A |
| Example 7 | Toner 7 | 0.0 | A | 4 | B | 13000 | A |
| Example 8 | Toner 8 | 2.8 | B | 2 | B | 11000 | B |
| Example 9 | Toner 9 | 3.6 | C | 3 | B | 12500 | B |
| Example 10 | Toner 10 | 1.5 | B | 4 | B | 6000 | C |
| Example 11 | Toner 11 | 3.2 | C | 2 | B | 12000 | B |
| Example 12 | Toner 12 | 2.0 | B | 2 | B | 14000 | A |
| Example 13 | Toner 13 | 0.0 | A | 7 | C | 13000 | A |
| Comparative Example 1 | Toner 14 | 5.0 | D | 5 | C | 11500 | B |
| Comparative Example 2 | Toner 15 | 1.0 | B | 5 | C | 4200 | D |
| Comparative Example 3 | Toner 16 | 3.9 | C | 6 | C | 4800 | D |
| Comparative Example 4 | Toner 17 | 0.0 | A | 12 | D | 9500 | C |
| Comparative Example 5 | Toner 18 | 5.1 | D | 1 | B | 4500 | D |
| Comparative Example 6 | Toner 19 | 5.4 | D | 3 | B | 14000 | A |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-169026, filed Aug. 28, 2015, which is hereby incorporated by reference herein in its entirety.

What is claimed is:

1. A toner comprising a toner particle containing a binder resin and a wax, wherein in a three-dimensional analysis of the internal structure of the toner particle, (i) the wax is present in domain form in the interior of the toner particle;

(ii) the proportion of toner particles for which a shortest distance between a surface of the toner particle and a domain having a largest major axis length among the domains of the wax is less than 50 nm, is equal to or less than 10.0 number %;

(iii) the proportion of toner particles for which the shortest distance between the surface of the toner particle and the domain having the largest major axis length is at least 50 nm and not more than 500 nm, is equal to or greater than 60.0 number %;

(iv) using d for a major axis length of the domain having the largest major axis length and using D for a number-average particle diameter (D1) of the toner, the d and D satisfy the relationship with the following formula (1)

$$0.25D<d<0.50D \quad (1); \text{ and}$$

(v) the ratio between the major axis length and a minor axis length (major axis length/minor axis length) of the domain having the largest major axis length is at least 1.0 and not more than 2.5.

2. The toner according to claim 1, wherein the wax contains a wax A and a wax B, the wax A being a hydrocarbon wax, and the wax B being an ester wax.

3. The toner according to claim 2, wherein the wax B is an ester of a hexahydric alcohol and an aliphatic acid or is an ester of a hexabasic carboxylic acid and an aliphatic alcohol.

4. The toner according to claim 2, wherein, using SPa for an SP value of the wax A and SPb for an SP value of the wax B, the following relationship is satisfied $$SPb-SPa>0.3.$$

5. The toner according to claim 1, wherein the toner particle contains a resin A, the resin A containing a polymer that has a segment with the following formula (2) in a terminal position in a side chain (2)

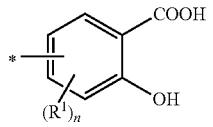

in the formula (2), each $R^1$ independently represents an alkyl group having at least 1 and not more than 18 carbons or an alkoxyl group having at least 1 and not more than 18 carbons; n represents an integer that is at least 0 and not more than 3; and * is a bonding segment in the polymer.

6. The toner according to claim 1, wherein the toner particle contains a resin A, the resin A containing a polymer that has a segment with the following formula (2-1) in a terminal position in a side chain;

(2-1)

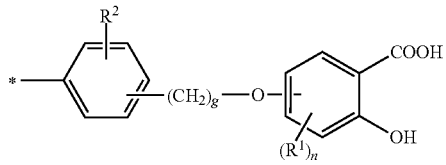

in the formula (2-1), each $R^1$ independently represents an alkyl group having at least 1 and not more than 18 carbons or an alkoxy group having at least 1 and not more than 18 carbons; $R^2$ represents a hydrogen atom, a hydroxy group, an alkyl group having at least 1 and not more than 18 carbons or an alkoxy group having at least 1 and not more than 18 carbons; g represents an integer that is at least 1 and not more than 3; h represents an integer that is at least 0 and not more than 3; and * is a bonding segment in the polymer.

* * * * *